US006364498B1

(12) United States Patent
Burbank

(10) Patent No.: US 6,364,498 B1
(45) Date of Patent: Apr. 2, 2002

(54) FAIL-SAFE ILLUMINATED DISPLAY COMPRISING MULTIMODAL ILLUMINATION COMPONENTS

(75) Inventor: Robert M. Burbank, Lebanon, NH (US)

(73) Assignee: Astronics Corporation, Buffalo, NY (US)

( * ) Notice: Subject to any disclaimer, the term of this patent is extended or adjusted under 35 U.S.C. 154(b) by 0 days.

(21) Appl. No.: 09/470,654

(22) Filed: Dec. 22, 1999

(51) Int. Cl.[7] ..... G09F 13/20
(52) U.S. Cl. ..... 362/84; 362/260; 40/542
(58) Field of Search ..... 362/84, 260; 40/542–544; 252/301.2, 463.1; 250/462–467; 368/67, 227

(56) References Cited

U.S. PATENT DOCUMENTS

| | | | | | |
|---|---|---|---|---|---|
| 5,469,020 | A | * | 11/1995 | Herrick | 313/511 |
| 5,711,595 | A | * | 1/1998 | Gerbe | 362/84 |
| 5,724,909 | A | * | 3/1998 | Pitman et al. | 116/202 |
| 5,775,016 | A | * | 7/1998 | Chien | 40/544 |
| 5,876,108 | A | * | 3/1999 | Chien | 362/35 |
| 5,961,072 | A | * | 10/1999 | Bodle | 244/118.5 |
| 5,980,060 | A | * | 11/1999 | Chien | 362/103 |
| 6,042,241 | A | * | 3/2000 | Lengyel | 362/84 |
| 6,279,180 | B1 | * | 8/2001 | Bell et al. | 4/661 |

FOREIGN PATENT DOCUMENTS

EP 0 106 662 4/1984

OTHER PUBLICATIONS

Guylène Proulx and Dale Tiller, Assessment of Photoluminescent Material During Office Occupant Evacuation, Institute for Research in Construction, National Research Council of Canada, Internal Report No. 774, Apr. 1999.

* cited by examiner

*Primary Examiner*—Sandra O'Shea
*Assistant Examiner*—Anabel Ton
(74) *Attorney, Agent, or Firm*—Steven J. Hulquist; Marianne Fuierer

(57) ABSTRACT

An illuminated display that is susceptible to interruption or termination of active lighting capability and provides passive lighting capability in such circumstances. The illuminated display features an active illumination source providing active lighting capability and a display member (i) arranged in light-receiving relationship to the active illumination source and (ii) containing photoluminescent pigment incorporated therein in sufficient amount and distribution to illuminate the display during the interruption or termination of active lighting capability, to provide passive lighting capability. The illuminated display may further include a fluorescent pigment arranged in photoluminescent light-receiving relationship to the display member containing the photoluminescent pigment, whereby the fluorescent pigment down-converts photoluminescent light from the display member during the interruption or termination of active lighting capability.

32 Claims, 4 Drawing Sheets

FAIL-SAFE ILLUMINATED DISPLAY COMPRISING MULTIMODAL ILLUMINATION COMPONENTS

BACKGROUND OF THE INVENTION

1. Field of Invention

The present invention generally relates to a lighted display, e.g., for signage or other visual communication, comprising multimodal illumination components arranged for illuminative operation even during temporal loss of power to the display.

2. Brief Description of the Related Art

Many forms of visual displays must be readily visible under a wide variety of lighting conditions. As discussed herein, the term "display" is to be understood as broadly including informational, pictorial or graphic displays, e.g., containing alphabetic and/or numeric text, graphic components, icons, symbols or other visually discernable indicia. Specific examples include: signage such as scoreboards, schedule displays in airport terminals, bus stations, train stations, and stadiums; instrument displays, such as those found in the instrument panels of aircraft cockpits, automobiles, and in other vehicles; and display panels on industrial and office equipment, appliances, telephones, numeric/alphanumeric keypads, computer/typewriter keyboards, and other human-machine interface structures and components. To provide sufficient illumination under low ambient lighting conditions such displays typically contain integral lighting components, such as incandescent bulbs, LEDs, fluorescent tubes, or electroluminescent panels, coupled in powered relationship to a power supply or other energy source or conversion means. In visibility-critical applications, such powered-lighting displays often also include a backup power system, e.g., an uninterruptable power supply (UPS), redundant power source, battery back-up, or other power delivery means, to provide illumination in the event of failure or interruption of power delivery to the lighting structure or component(s) of the display.

As one example of lighted displays known in the art, Klein U.S. Pat. No. 4,217,625 discloses a front-lighted display for an instrument dial face and pointer comprising in one embodiment a plurality of LEDs arranged around the front of the dial face for direct illumination, and in another embodiment, a mechanical digital counter readout is frontally illuminated with LEDs, with the LEDs being shielded from direct view by a reflector. Klein U.S. Pat. No. 4,044,708 discloses a transilluminated instrument, with LEDs arranged around the back side of the dial face, illuminating a reflective diffuser surface and thereby backlighting the instrument. In an alternative embodiment, a separate LED directly backlights a dial pointer.

Muggli U.S. Pat. No. 5,456,955 discloses a back-illuminated display using a clear separation layer between an underlying light-transmissive/diffusion layer and an overlying light-absorptive layer to facilitate etching of indicia through the light-absorptive layer by a neodymium YAG laser, for applications such as providing keypad alphanumeric indicators.

Lerner U.S. Pat. No. 5,433,024 discloses an advertising sign comprising a tapered transparent acrylic plate illuminated at its thickest edge, and backlighting indicia applied to the oblique faces of the plate.

Streit U.S. Pat. No. 4,684,939 describes an illuminated LCD display, comprising a fluorescent light source and shielding reflector positioned to illuminate the display from the direction that achieves optimum contrast of the LCD active area for the observer under ambient diff-use illumination conditions.

The use of fluorescent materials to enhance the visibility of signs is known in the art. Fluorescent dyes and pigments are commonly used to alter color and enhance contrast in such applications, but are ineffective without incident light.

Fluorescent phosphors are also employed to down-convert photonic energy for illumination. Lengyel et al. U.S. Pat. No. 5,907,222 describes a backlit sign in which a cavity behind the display is coated with a fluorescent phosphor. A cavity-mounted UV excites the phosphor, causing it to emit light in the visible spectrum to backlight the display.

All actively illuminated displays of the prior art suffer the significant deficiency that they become unreadable in low or no ambient light conditions, e.g., upon a failure or interruption of power delivery to the display.

In critical applications, such as instrumentation in aircraft and other vehicles, or signs demarcating emergency exits, a backup power source for illumination must be provided, increasing the cost, complexity, and labor requirements (inspection, testing and maintenance) of the overall system.

In addition to failure from loss or interruption of power, all actively illuminated displays suffer the deficiency of loss of readability through failure of one or more of the active illumination elements (such as incandescent bulbs, LEDs, fluorescent tubes, etc.) or their associated circuitry components. These displays may be designed to include various redundancies to increase their reliability, but this also increases cost, complexity, and maintenance requirements of the overall system.

It is thus an object of the present invention to provide a display with a high visibility/readability under daylight or normal ambient illumination, as well as under low or no ambient light conditions, as well as following failure of the active light source or its associated power delivery components.

Other objects and advantages of the invention will be more fully appreciated with reference to the ensuing disclosure and appended claims.

SUMMARY OF THE INVENTION

The present invention relates to an illuminated display that is susceptible to interruption or termination of active lighting capability and provides passive lighting capability in such circumstances.

In one embodied aspect, the illuminated display comprises:

an active illumination source providing said active lighting capability; and a display member (i) arranged in light-receiving relationship to the active illumination source and (ii) containing photoluminescent pigment incorporated therein in sufficient amount and distribution to illuminate the display during said interruption or termination of active lighting capability, to provide said passive lighting capability.

The illuminated display may further comprise fluorescent dyes/pigments arranged in photoluminescent light-receiving relationship to the display member containing the photoluminescent pigment, whereby the fluorescent dyes/pigments down-converts photoluminescent light from the display member during the interruption or termination of active lighting capability.

The invention relates in another aspect to an illuminated display that is susceptible to interruption or termination of active lighting capability and provides passive lighting capability in such circumstances, wherein the illuminated display comprises:

an active illumination source providing said active lighting capability;

an optically non-opaque display member (i) forming at least part of a housing for the illuminated display, (ii) arranged in light-receiving relationship to the active illumination source and (iii) containing photoluminescent pigment incorporated therein in sufficient amount and distribution to illuminate the display during the interruption or termination of active lighting capability, to provide the aforementioned passive lighting capability; and a fluorescent dye/pigment on or in the display member, for down-converting photoluminescent light from the display member during the interruption or termination of active lighting capability.

In a method aspect, the invention relates to a method of providing passive lighting capability for an actively illuminated display including an active illumination source that is susceptible to interruption or termination of active lighting capability, so that light is provided to the display during said interruption or termination. The method comprises:

arranging in light-receiving relationship to the active illumination source a display member containing photoluminescent pigment incorporated therein in sufficient amount and distribution to illuminate the display during the interruption or termination of active lighting capability, to provide the aforementioned passive lighting capability.

A further aspect of the invention relates to a method of providing sustained illumination, comprising coupling a powered illumination source with a photoluminescent pigment arranged in light-receiving relationship to the powered illumination source, whereby the photoluminescent pigment provides illumination in the event of failure of the powered illumination source.

Other aspects, features and embodiments of the invention will be more fully apparent from the ensuing disclosure and appended claims.

DETAILED DESCRIPTION OF THE INVENTION, AND PREFERRED EMBODIMENTS THEREOF

Figure 1:
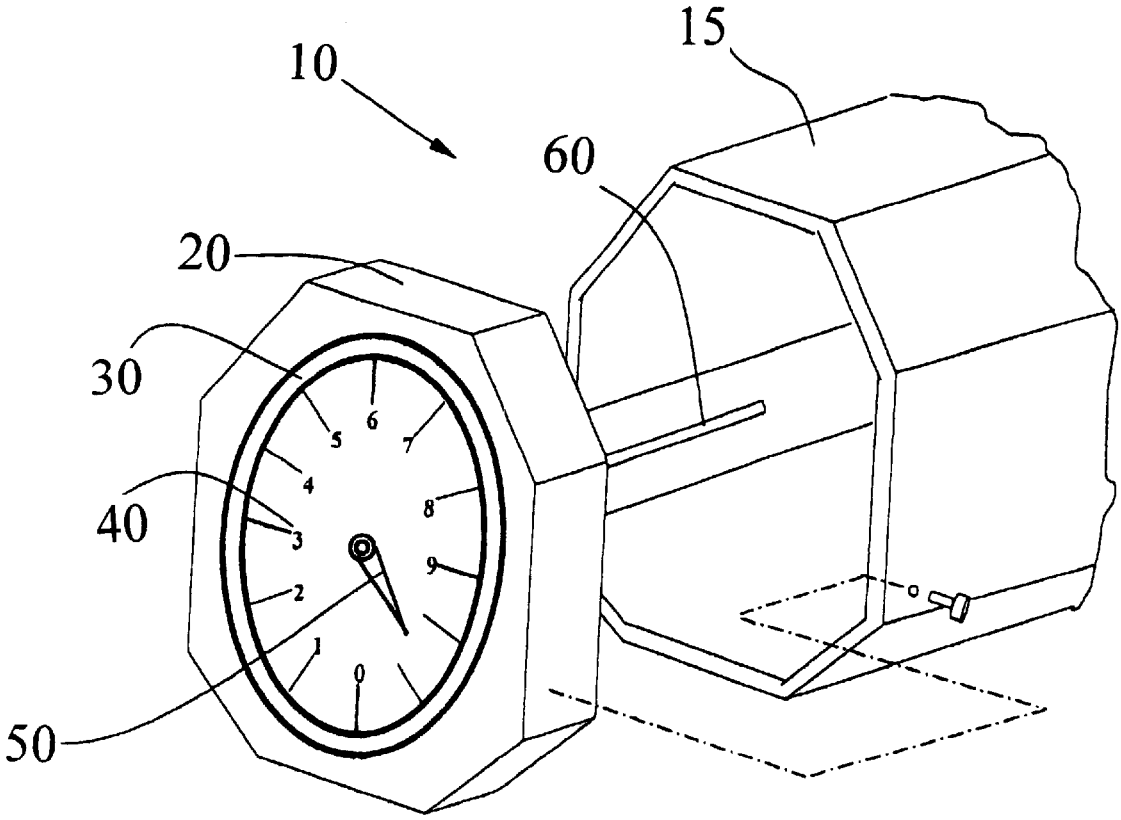
FIG. 1 is an exploded perspective view of an instrument display according to one embodiment of the present invention.

The present invention generally relates to lighted display, e.g., for signage or other visual communication, comprising multimodal illumination components arranged for illuminative operation even during temporal loss of power to the display.

More particularly, the present invention relates to a display utilizing conventional powered lighting means, and photoluminescent pigment which is charged by daylight or the powered lighting means, and provide passive illumination in the event of loss of power. The photoluminescent material stores optical energy when exposed to ambient light, and slowly radiates optical energy long after the redution or removal of the ambient light. Typically, photoluminescent materials absorb energy in the UV to blue range and re-emit energy in the blue to red and near IR range. The passive illumination capability of the display may further be augmented by the provision of fluorescent material provided in light-receiving relationship to the photoluminescent material, e.g., on or within a display member containing the photoluminescent pigment.

The display of the present invention is susceptible of being used in many applications, including: advertising displays; instrumentation in aircraft, ships, trains, automobiles and other motive vehicular structures; displays on machines such as computers, appliances, and industrial process monitoring equipment; illuminated exit signs in buildings, stadiums, circus tents, etc.; directional indicators demarcating emergency egress pathways; and signs identifying the location of emergency equipment, such as first-aid kits, communications facilities, life rafts, etc.

The invention may be applied in any other applications requiring illumination and visibility for an extended duration following the termination or interruption of power to an active lighting element, e.g., in which a sign, display or other visual components or indicia must remain visible and readable in low or no ambient light conditions when active lighting components and/or their associated power delivery means, have failed or been interrupted in operation, or where a redundant or backup lighting means and/or power source would unduly increase system cost, weight, complexity, or maintenance requirements, or would negatively impact system reliability.

It will therefore be understood that the specific and illustrative examples provided herein are not to be limitingly construed or interpreted, as regards the scope and applicability of the illumination apparatus and method of the present invention.

The present invention is based on the discovery that photoluminescent pigments, alone or in combination with fluorescent pigments, can be operatively coupled with an active illumination means, to provide fail-safe illumination when the active lighting elements fail or are interrupted in operation. The invention thus combines a passive illumination means (photoluminescence) with an active illumination means (powered lighting elements), in such a way that operational efficacy of the passive system is assured in the event of loss or interruption of the normal operation capability of the active system.

The photoluminescent material employed in the practice of the present invention may be of any suitable type. The photoluminescent material may be employed in a housing formed of any suitable shape and thickness characteristics, as may be readily determined without undue effort by simple empirical testing of the display in the specific use environment in which it is intended to operate, involving determination of the resultant luminescence achieved when the sign is powered by its active lighting elements and the luminescence output when the lighting assembly is subjected to dark conditions.

The photoluminescent pigment may be compounded or incorporated in a panel or other structural element of the display, e.g., as a coating of the photoluminescent material dispersed in a clear binder that is coated on a face or housing structure of the display, or alternatively with dispersion of the photoluminescent component in the structural element of the display, e.g., as an additive to a non-opaque resin or glass composition that is molded, cast or otherwise formed into a component structural element of the display.

By way of illustrative example, the photoluminescent pigment utilized in the practice of the invention may be of a blue or green type as for example is described in Hao U.S. Pat. No. 5,853,614. Alternatively, the photoluminescent pigment may be of a green-yellow type, as for example is described in Glatz, et al. U.S. Pat. No. 5,904,017. The photoluminescent material may comprise strontium oxide aluminate chemistry or one or more phosphorescent metal sulfides such as zinc sulfide or calcium sulfide, in combination with one or more compounds that absorb energy of short wave-length and emit it at wave-lengths that lie within the absorption spectrum of the phosphorescent constituent or constituents of the composition, e.g., an aromatic hydrocarbon, e.g., diphenyloxazole, 2,5-diphenylfurane, para-phenylene-2,2'-bis(phenyl-5-oxazole) or its dimethyl derivative, di-(3-ethylheptyl)-para-quinquephenyl, etc.

Optionally, the photoluminescent composition may include one or more fluorescent substances having an emission spectrum located towards the longer wave-lengths within or outside the absorption/emission spectrum of the phosphorescent material or materials, e.g., rhodamine B, fluorescein or uranine S. The function of such fluorescent substances is to convert the photoluminescent energy to contrasting colors to give the article the ability to light in multiple colors or a color different from the photoluminecent pigment. The photoluminescent material may for example comprise a strontium oxide aluminate and a rhodamine dye, a fluorescent family of substances that emits light at various wavelengths in the visible range.

In a preferred embodiment of the present invention, fluorescent pigments are employed to enhance the contrast of the sign and improve its readability under normal ambient light or active illumination. Fluorescent pigments typically absorb incident light and re-emit it at higher wavelengths, normally in the yellow and red spectral regime. In the passive illumination condition, the fluorescent pigments down-convert the luminous energy from the photoluminescent pigments, to better enhance the contrast of the sign.

By altering the chemical compositions of the photoluminescent and fluorescent pigments, various colors and color combinations can be engineered, to optimally illuminate the sign in both the active and passive illumination mode.

The fluorescent pigments may be of any suitable type, and the position and thickness of the fluorescent pigment layer in a specific end-use application may be readily determined by one of ordinary skill in the art without undue experimentation. Merchak, et al. U.S. Pat. No. 5,863,459 discloses a fluorescent yellow pigment, and describes various fluorescent dyes and pigments known in the art.

The active lighting elements in the illumination device of the present invention may be of any suitable type and configuration that sufficiently illuminate the display in low or no ambient light conditions. Such active lighting elements may comprise, for example, incandescent bulbs, LEDs, fluorescent tubes, electroluminescent lamps, or combinations thereof.

The active lighting elements may be positioned in any location that suitably illuminates both the display and the photoluminescent material. In one embodiment, the active lighting elements may be placed behind a photoluminescent housing so as to simultaneously backlight the display and "charge" (energize) the photoluminescent material. The active lighting elements may be powered by any appropriate configuration of power supply and wiring or other energizing circuitry, as are well known in the art associated with the respective active lighting element types.

The present invention may for example be embodied in a lighted display, e.g., for signage or other visual communication, comprising multimodal illumination components arranged for illuminative operation even during temporal loss of power to the display. Such display may utilize fluorescent materials in indicia thereon in combination with conventional powered lighting means, and photoluminescent pigments that are charged by daylight or the powered lighting means, and illuminate the indicia in the event of loss of power.

In one embodiment, the invention comprises a sign including a housing fabricated of a material containing photoluminescent material. The sign is readable under daylight or normal ambient light. During low or no ambient light conditions, an active powered light source illuminates the sign, while continuously charging the photoluminescent material. Upon power outage or other failure of the light source during low or no ambient light conditions, the photoluminescent material "glows," emitting luminous energy sufficient to illuminate the sign, rendering it readable.

In a further embodiment, the display includes a layer of fluorescent pigment. Under daylight ambient lighting conditions and when the sign is illuminated by the active lighting elements, the fluorescent pigment adds color and contrast and enhances the readability of the sign. Upon power outage or other failure or interruption of the light source during low or no ambient light conditions, the luminous energy released by the photoluminescent pigment is selectively down-converted (transformed to longer wavelength visible radiation) by the fluorescent pigment, to better emphasize the sign indicia.

The display may be arranged with a housing including a display panel containing or associated with both the photoluminescent and fluorescent materials, wherein the active light source is internal disposed in the housing, such that the display is backlighted during normal use.

This invention obviates the need for emergency backup power systems to safeguard against power failure to the active lighting means. The invention also obviates the need for redundancy, or other reliability measures, to safeguard against failure of the lighting means itself.

Photoluminescent materials are well known in the art, and include for example strontium oxide aluminate, zinc sulfide, calcium sulfide, and strontium sulfide. The intensity of illumination provided by photoluminescent materials begins to decay immediately upon the removal of ambient or charging light. However, human visual perception increases shortly after the removal of ambient light, as physiological adjustments occur to the eye, and individuals progress to the achievement of "night vision." Thus, photoluminescent materials may provide sufficient luminous energy to a sign to render it readable for several hours following the removal of ambient or powered light.

Referring now to the drawings, FIG. 1 depicts instrument display 10, comprising instrumentation case 15 composed of a suitable material (e.g., aluminum, plastic, etc.), and housing 20 composed of a material that is optically translucent and contains photoluminescent pigments. In a preferred embodiment, a fluorescent pigment layer 30 may be disposed over a face of the housing 20. Indicia 40 are affixed to the fluorescent pigment layer 30, e.g., by conventional silk screen means, or by attaching an optically transparent film with the indicia printed or otherwise affixed thereon. Pointer 50 is connected to pointer shaft 60, which is operatively coupled to instrumentation (not shown) that is mounted or otherwise contained in the instrumentation case 15.

Figure 2:
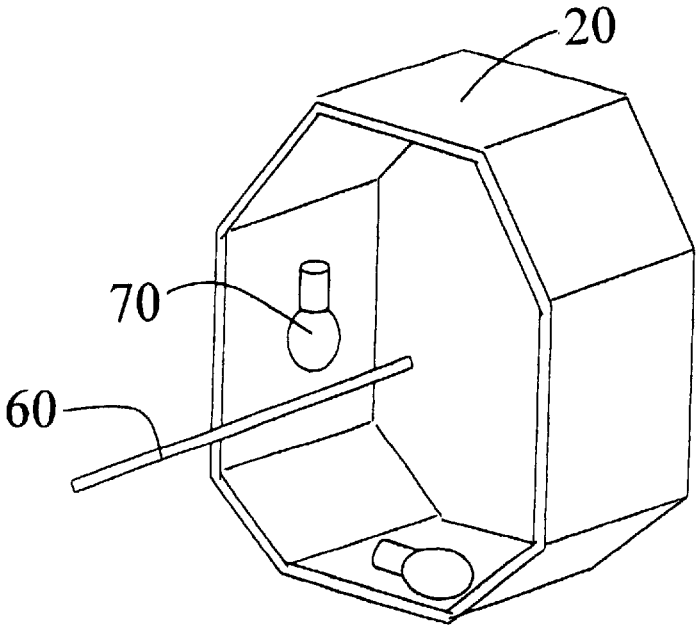
FIG. 2 is a rear perspective view of the instrument display of FIG. 1, showing the light sources mounted therein.

FIG. 2 (correspondingly numbered with respect to FIG. 1, for ease of reference and description) shows the interior side of housing 20. Sub-miniature lights 70 are mounted within housing 20 in a spaced relationship to one another, to provide substantially uniform illumination through the translucent face of housing 20 and the fluorescent pigment layer 30 as shown on FIG. 3. While lights 70 are depicted as sub-miniature incandescent light elements, it is apparent that a variety of lighting means could be utilized, including LEDs, fluorescent tubes, or electroluminescent lamp elements. Furthermore, the number and spacing or density of active lighting elements may be suitably varied in a given application, the appropriately illuminate the display indicia 40.

Figure 3:
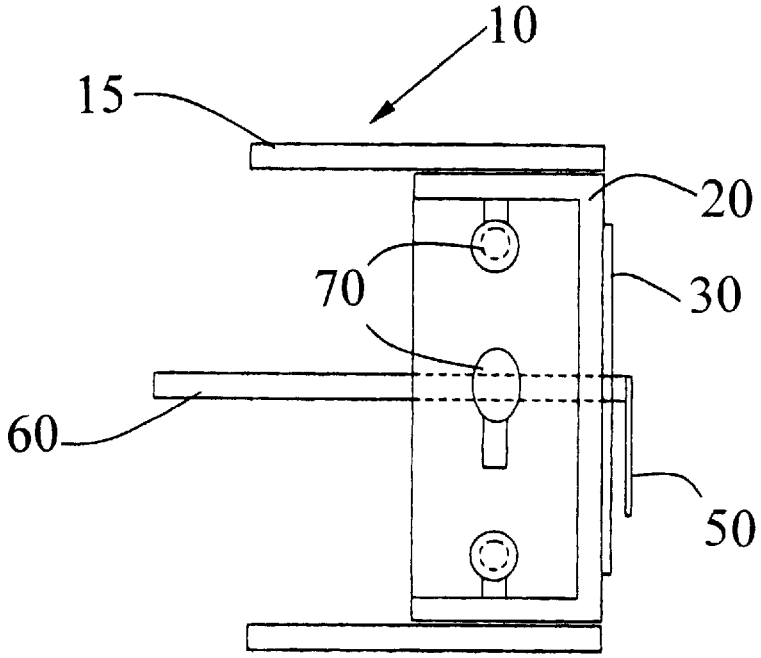
FIG. 3 is a sectional side-elevation view of the instrument display of FIGS. 1 and 2.

FIG. 3 (correspondingly numbered with respect to FIGS. 1 and 2, for ease of reference and description) depicts the forward portion of instrument display 10 in its operative configuration, showing various features and elements of the invention in relationship to each other.

It will be apparent from inspection of FIGS. 2 and 3 that the housing 20 serves to diffuse light from lamps 70, providing a substantially uniform backlit illumination across the sign indicia 40. It will be correspondingly apparent that the photoluminescent pigments in housing 20 are continuously charged by light emanating from lamps 70 whenever the display is operated in active illumination mode.

Thus, following operation of instrument display 10 in active illumination mode for a short duration, the lamps 70 may all fail (either by failure of the lamps themselves, their wiring, their control circuit, their power supply, or system-wide power), and housing 20 in combination with fluorescent pigment layer 30 will provide sufficient illumination to discern and read the display indicia 40 and the position of pointer 50 thereon. The instrument display 10 of the present invention thus provides a passive, fail-safe means of ensuring illumination sufficient to render the instrument display operable for a discrete period of time and useful in low or no ambient light conditions.

Figure 4:
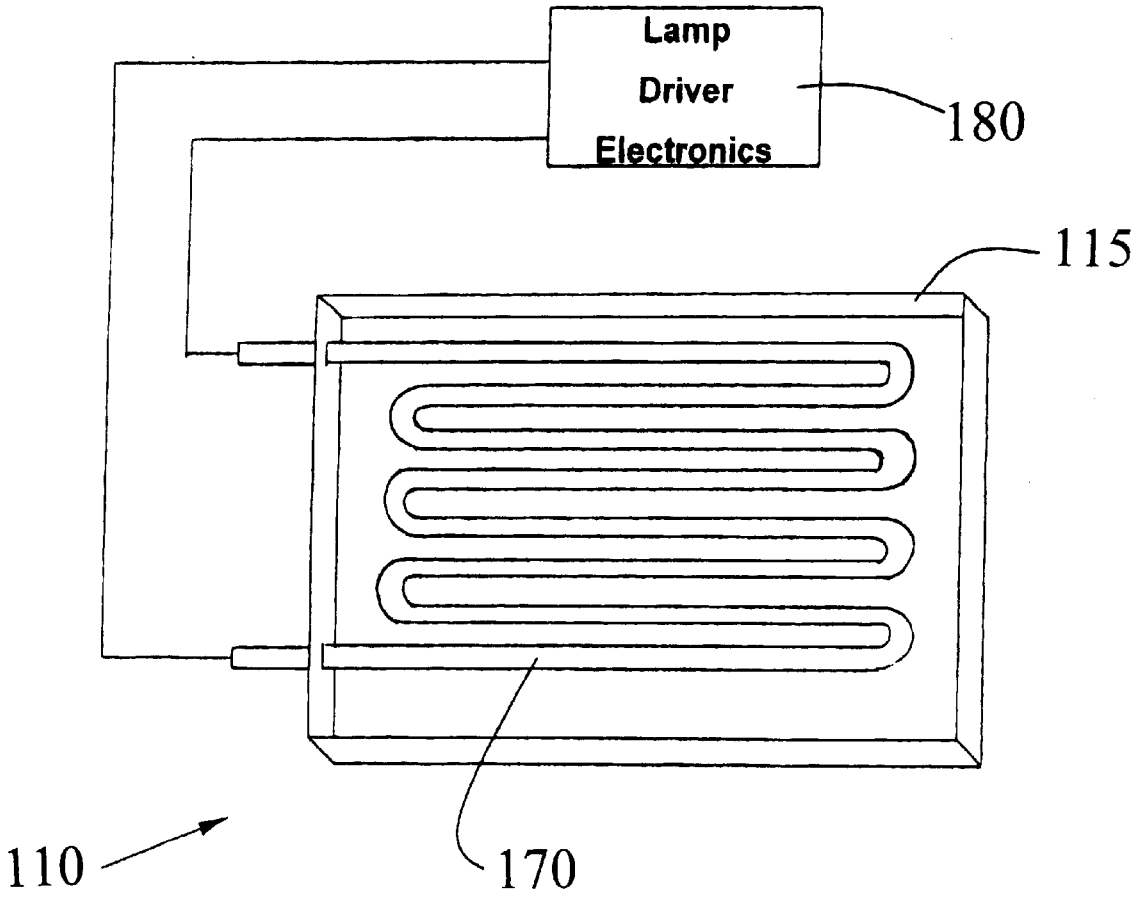
FIG. 4 is a simplified schematic representation of a portion of a sign according to one embodiment of the present invention.
Figure 5:
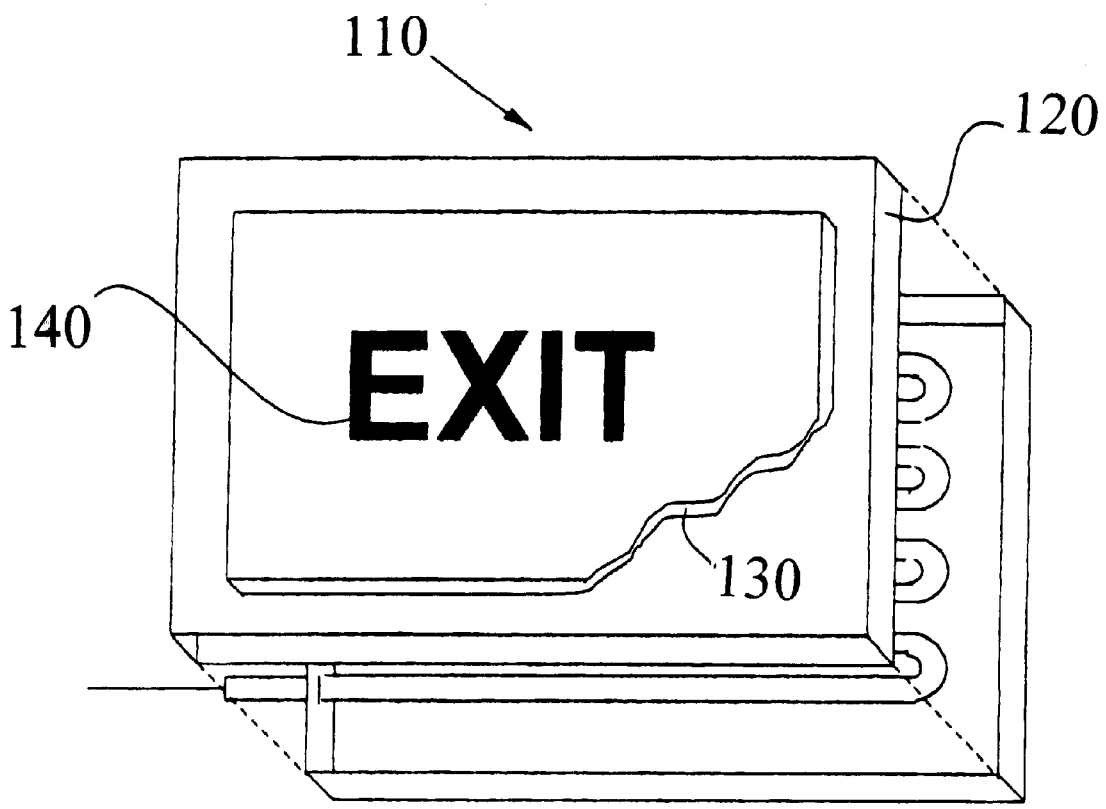
FIG. 5 is an exploded perspective view of the sign of FIG. 4, as assembled and comprising a housing, fluorescent pigment layer, and display indicia.

FIGS. 4 and 5 depict an exit sign display 110, according to another embodiment of the present invention. The housing 115, fabricated of any suitable material, e.g., aluminum, plastic, etc., contains fluorescent lamp element 170, which is electrically and operatively coupled to the lamp driver electronics module 180. While lamp 170 is depicted as a curved fluorescent tube, it is apparent that this function can be performed by a variety of other lighting means, including incandescent bulbs, LEDs, or electroluminescent lamps.

The housing panel 120 is suitably formed to matably engage the housing 115, e.g., as a face panel or overlay therefor, and the panel 120 is fabricated of a material that is optically translucent and contains photoluminescent pigments. Deposited or otherwise positioned on housing 120 is one or more areas of a fluorescent pigment 130. Alphanumeric, graphical, or iconic indicia, such as the letters 140 of the word "EXIT," are affixed to the housing panel 120 in any suitable manner, e.g., by conventional silk screen techniques, by attaching an optically transparent film with the indicia affixed thereon, or in any other suitable manner or using any other suitable means.

The face panel assembly 120, 130 and 140, may comprise a variety of lighting and color combinations, as may readily suggest themselves to one of ordinary skill in the art, without undue experimentation, within the broad practice of the present invention.

It will be apparent from FIGS. 4 and 5 that housing 120 serves to diffuse light from lamp 170, providing a substantially uniform backlit illumination across the sign indicia 140. It will be correspondingly apparent that the photoluminescent pigments in housing 120 are continuously charged by light emanating from lamp 170 whenever the sign is operated in active illumination mode.

Thus, following operation of sign 110 in an active illumination mode for a duration of normal operation, lamp 170 or lamp driver electronics 180 may fail, and housing 120 in combination with fluorescent pigment layer 130 will for a period of time thereafter provide sufficient illumination to discern and read sign indicia. The sign 110 of the present invention thus provides a passive, fail-safe means of ensuring illumination sufficient to render the sign readable and useful in low or no ambient light conditions.

While the invention has been described herein with reference to specific features and illustrative embodiments, it will be recognized that the utility of the invention is not thus limited, but rather extends to and encompasses other features, modifications and alternative embodiments as will readily suggest themselves to those of ordinary skill in the art based on the disclosure and illustrative teachings herein. The claims that follow are therefore to be construed and interpreted as including all such features, modifications and alternative embodiments within their spirit and scope.

What is claimed is:

1. An illuminated display that is susceptible to interruption or termination of active lighting capability and provides passive lighting capability in such circumstances, said illuminated display comprising:

(a) an active illumination source providing said active lighting capability; and (b) a display member containing photoluminescent pigment incorporated therein in sufficient amount and distribution to illuminate the display during said interruption or termination of active lighting capability, to provide said passive lighting capability;

wherein the display member containing photoluminescent pigment is arranged in light-receiving relationship to the active illumination source, and wherein the active illumination source simultaneously backlights the display member and charges the photoluminescent pigment contained by said display member.

2. The illuminated display of claim 1, further comprising fluorescent pigment arranged in photoluminescent light-receiving relationship to the display member containing said photoluminescent pigment, whereby the fluorescent pigment down-converts photoluminescent light from the display member during the interruption or termination of active lighting capability.

3. The illuminated display of claim 1, wherein said display member comprises an optically translucent material.

4. The illuminated display of claim 3, wherein the display member forms at least a portion of a housing for the display in which the active illumination source is disposed.

5. The illuminated display of claim 3, wherein the display member forms at least of a portion of a housing for the display behind which the active illumination source is disposed.

6. The illuminated display of claim 1, wherein the active illumination source comprises a lighting element that emits energy at wavelengths that lie within the absorption spectrum of the photoluminescent pigment for charging said photoluminescent pigment.

7. The illuminated display of claim 1, wherein said photoluminescent pigment comprises a phosphorescent metal sulfide or strontium oxide aluminate.

8. The illuminated display of claim 1, wherein said photoluminescent pigment comprises strontium oxide aluminate.

9. The illuminated display of claim 1, wherein the photolumescent pigment comprises a metal sulfide selected from the group consisting of zinc sulfide and calcium sulfide.

10. The illuminated display of claim 1, wherein said photoluminescent pigment comprises strontium oxide aluminate and an aromatic hydrocarbon.

11. The illuminated display of claim 10, wherein said aromatic hydrocarbon comprises a compound selected from the group consisting of diphenyloxazole, 2,5-diphenylfurane, para-phenylene-2,2'-bis(phenyl-5-oxazole), dimethyl para-phenylene-2,2'-bis(phenyl-5-oxazole), and di-(3-ethylheptyl)-para-quinquephenyl.

12. An illuminated display that is susceptible to interruption or termination of active lighting capability and provides passive lighting capability in such circumstances, said illuminated display comprising:

(a) an active illumination source providing said active lighting capability; and (b) an optically non-opaque display member (i) forming at least part of a housing for the illuminated display, (ii) arranged in light-receiving relationship to the active illumination source and (iii) containing photoluminescent pigment incorporated therein in sufficient amount and distribution to illuminate the display during said interruption or termination of active lighting capability, to provide said passive lighting capability; and (c) a fluorescent pigment on or in the display member, for down-converting photoluminescent light from the display member during the interruption or termination of active lighting capability.

13. A method of providing passive lighting capability for an actively illuminated display including an active illumination source that is susceptible to interruption or termination of active lighting capability, so that light is provided to the display during said interruption or termination, wherein said method comprises:

arranging in light-receiving relationship to the active illumination source a display member containing photoluminescent pigment incorporated therein in sufficient amount and distribution to illuminate the display during said interruption or termination of active lighting capability, to provide said passive lighting capability, wherein said active illumination source simultaneously backlights said display member and charges the photoluminescent pigment contained by said display member.

14. The method of claim 13, further comprising providing a fluorescent pigment in light-receiving relationship to the display member, for down-converting photoluminescent light from the display member during the interruption or termination of active lighting capability.

15. The method of claim 13, wherein said display member comprises an optically translucent material.

16. The method of claim 15, wherein the display member forms at least a portion of a housing for the display in which the active illumination source is disposed.

17. The method of claim 15, wherein the display member forms at least of a portion of a housing for the display behind which the active illumination source is disposed.

18. The method of claim 13, wherein the active illumination source comprises a lighting element that emits energy at wavelengths that lie within the absorption spectrum of the photoluminescent pigment for charging said photoluminescent pigment.

19. The method of claim 13, wherein said photoluminescent pigment comprises strontium oxide aluminate or a metal sulfide.

20. The method of claim 19, wherein said photoluminescent pigment comprises strontium oxide aluminate.

21. The method of claim 19, wherein the phosphorescent metal sulfide comprises a metal sulfide selected from the group consisting of zinc sulfide and calcium sulfide.

22. The method of claim 13, wherein said photoluminescent pigment comprises strontium oxide aluminate and an aromatic hydrocarbon.

23. The method of claim 22, wherein said aromatic hydrocarbon comprises a compound selected from the group consisting of diphenyloxazole, 2,5-diphenylfurane, para-phenylene-2,2'-bis(phenyl-5-oxazole), dimethyl para-phenylene-2,2'-bis(phenyl-5-oxazole), and di-(3-ethylheptyl)-para-quinquephenyl.

24. A method of providing sustained illumination, comprising:

coupling a powered illumination source with a photoluminescent pigment arranged in light-receiving relationship to the powered illumination source, whereby the powered illumination source provides active illumination and continuously charges the photoluminescent pigment under powered conditions, and whereby the photoluminescent pigment provides passive illumination in the event of failure of the powered illumination source, and arranging a fluorescent pigment in light-receiving relationship to the photoluminescent pigment, to enhance illumination in the event of failure of the powered illumination source.

25. The illuminated display of claim 1, wherein said active illumination source comprises an incandescent lighting element.

26. The illuminated display of claim 1, wherein said active illumination source comprises a light emitting diode.

27. The illuminated display of claim 1, wherein said active illumination source comprises a fluorescent lighting element.

28. The illuminated display of claim 12, wherein the active illumination source is disposed in the optically non-opaque display member for simultaneously lighting the display member and energizing the photoluminescent pigment.

29. The illuminated display of claim 12, wherein said optically non-opaque display member further comprises one or more compounds arranged in light emitting relationship to said photoluminescent pigment, for absorbing energy of shorter wave-length and emitting it at longer wave-lengths that lie within the absorption spectrum of said photoluminescent pigment.

30. The method of claim 13, wherein said active illumination source comprises an incandescent lighting element.

31. The method of claim 13, wherein said active illumination source comprises a light emitting diode.

32. The method of claim 13, wherein said active illumination source comprises a fluorescent lighting element.

* * * * *